US011306960B2

(12) United States Patent
Hong et al.

(10) Patent No.: US 11,306,960 B2
(45) Date of Patent: Apr. 19, 2022

(54) REFRIGERATOR HAVING DETACHABLE COOLING MODULE

(71) Applicant: SAMSUNG ELECTRONICS CO., LTD., Suwon-si (KR)

(72) Inventors: Dae Jin Hong, Suwon-si (KR); Il Sung Bae, Suwon-si (KR); Byung Kwan Yang, Suwon-si (KR); Byung Woo Jeon, Suwon-si (KR); Sun Gi Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 62 days.

(21) Appl. No.: 16/715,939

(22) Filed: Dec. 16, 2019

(65) Prior Publication Data

US 2020/0200463 A1 Jun. 25, 2020

(30) Foreign Application Priority Data

Dec. 19, 2018 (KR) ..... 10-2018-0165508

(51) Int. Cl.
*F25D 17/08* (2006.01)
*F25D 19/00* (2006.01)
*F25D 23/02* (2006.01)

(52) U.S. Cl.
CPC ..... *F25D 17/08* (2013.01); *F25D 19/00* (2013.01); *F25D 23/025* (2013.01); *F25D 2317/067* (2013.01); *F25D 2500/02* (2013.01)

(58) Field of Classification Search
CPC ..... F25D 17/08; F25D 19/00; F25D 23/025; F25D 2317/067; F25D 2500/02; F25D 23/006; F25D 23/10
See application file for complete search history.

(56) References Cited

U.S. PATENT DOCUMENTS

2009/0000316 A1* 1/2009 Cohen ..... F25D 19/00 62/77
2014/0338387 A1 11/2014 Jiang
(Continued)

FOREIGN PATENT DOCUMENTS

CN 108548355 A 9/2018
EP 1 691 152 A1 8/2006
(Continued)

OTHER PUBLICATIONS

International Search Report dated Mar. 24, 2020, in corresponding International Patent Application No. PCT/KR2019/016061.
(Continued)

*Primary Examiner* — Cassey D Bauer
(74) *Attorney, Agent, or Firm* — Staas & Halsey LLP

(57) ABSTRACT

A refrigerator including a cabinet in which a storeroom is formed and including a duct opening; a cooling module detachably coupled to the cabinet and including an evaporator, a condenser, a compressor, a module body having a space in which the evaporator is accommodated, and a duct module detachably coupled to the module body to guide cold air produced from the evaporator to the storeroom, wherein the duct opening, the duct module and the storeroom are arranged so that, when the duct module is detached from the module body, the duct module is passable through the duct opening to be removed through the storeroom.

19 Claims, 14 Drawing Sheets

(56) References Cited

U.S. PATENT DOCUMENTS

| | | | | |
|---|---|---|---|---|
| 2015/0168048 | A1* | 6/2015 | Sexton | F25D 23/062 62/329 |
| 2018/0224188 | A1 | 8/2018 | Lee et al. | |

FOREIGN PATENT DOCUMENTS

| | | | |
|---|---|---|---|
| JP | 2005-226910 | | 8/2005 |
| KR | 1995-0012006 | | 5/1995 |
| KR | 10-2003-0027367 | A | 4/2003 |
| KR | 10-0724445 | B1 | 6/2007 |
| KR | 10-2009-0113577 | A | 11/2009 |
| WO | WO2012130580 | * | 3/2012 |

OTHER PUBLICATIONS

Extended European Search Report dated Nov. 4, 2021, in European Application No. 19 90 0241.

* cited by examiner

REFRIGERATOR HAVING DETACHABLE COOLING MODULE

CROSS-REFERENCE TO RELATED APPLICATION

This application is based on and claims priority under 35 U.S.C. § 119 to Korean Patent Application No. 10-2018-0165508 filed on Dec. 19, 2018 in the Korean Intellectual Property Office, the disclosure of which is incorporated herein by reference in its entirety.

BACKGROUND

1. Field of the Invention

The disclosure relates to refrigerators, and more particularly, to a refrigerator having an enhanced structure of a cold air supply system.

2. Discussion of Related Art

Refrigerators are home appliances having a main body with storerooms and a cold air supply system for supplying cold air into the storerooms, to keep food and groceries fresh. The storerooms include a fridge maintained at temperatures of about 0 to 5 degrees Celsius for keeping groceries cool, and freezer maintained at temperatures of about 0 to −30 degrees in Celsius for keeping groceries frozen.

For the fridge, insulation is provided in a cabinet that forms the storeroom and a machine room is provided outside the cabinet. Of components of the cold air supply system, a compressor and a condenser are arranged in the machine room provided outside the cabinet; an evaporator is arranged in a storeroom formed inside the cabinet; and a refrigerant tube in which a refrigerant flows is arranged to pass through the insulation.

With this structure, on an occasion when cooling performance of the refrigerator needs to be tested, the cooling performance may be tested only after all the components of the cold air supply system are installed at the cabinet. Moreover, when the cold air supply system requires maintenance or repair, the cabinet needs to be disassembled.

SUMMARY OF THE INVENTION

The disclosure provides a refrigerator allowing a cold air supply system to be easily maintained or repaired.

The disclosure also provides a refrigerator whose manufacturing process is enhanced, leading to an increase in productivity.

In accordance with an aspect of the disclosure, a refrigerator includes a cabinet in which a storeroom is formed and including a duct opening; a cooling module detachably coupled to the cabinet and including an evaporator, a condenser, a compressor, a module body having a space in which the evaporator is accommodated, and a duct module detachably coupled to the module body to guide cold air produced from the evaporator to the storeroom, wherein the duct opening, the duct module and the storeroom are arranged so that, when the duct module is detached from the module body, the duct module is passable through the duct opening to be removed through the storeroom.

When the duct module is removed, the evaporator may be exposed, and thereby accessible, through the storeroom and the duct opening.

The cooling module may include a base plate underneath the module body, and the compressor and the condenser may be coupled to the base plate.

The refrigerator may further include a sealing member arranged where the cooling module and the cabinet are coupled to each other.

The sealing member may be arranged along an outer edge of a periphery of the duct opening.

The sealing member may have a portion extending along a periphery of the space.

The duct module may include a fan configured to circulate air in the storeroom, a fan case having a fan inlet formed to guide air that has exchanged heat with the evaporator to the fan, and a fan cover having a cover hole formed to guide air blown by the fan to the storeroom.

The fan may be fixed to the fan cover, and the fan cover may be detachable from the fan case.

The refrigerator may further include a storeroom cover configured to cover the duct opening and having a cover opening for communicating the duct module with the storeroom.

The duct module may include a duct inlet formed to guide air in the storeroom to the evaporator.

The cabinet may include a separation plate dividing the storeroom into a first storeroom and a second storeroom, and the duct module may include a first duct module to discharge cold air into the first storeroom, and a second duct module to discharge cold air into the second storeroom.

The separation plate may be detachably coupled to the cabinet or the module body.

The duct opening may include a first duct opening through which the first duct module is passable to be removed through the first storeroom, and a second duct opening through which the second duct module is passable to be removed through the second storeroom.

The cabinet may form a cooling module receiving space which is opened to outside of the refrigerator when the cooling module is detached from the cabinet, and, when the cooling module is coupled to the cabinet, the cooling module may be accommodated in the cooling module receiving space.

In accordance with another aspect of the disclosure, a refrigerator includes a cabinet in which a storeroom is formed and including a duct opening; an evaporator; a module body in which the evaporator is accommodated; and a duct module detachably coupled the module body to guide air from the evaporator to the storeroom, wherein the duct opening, the module body and the storeroom are arranged so that, when the duct module is detached from the module body, the duct module is passable through the duct opening to be removed through the storeroom, and, when the duct module is removed, the evaporator is accessible through the storeroom and the duct opening.

The refrigerator may further include a cooling module including the module body and the evaporator, and further including a compressor and a condenser, wherein the cooling module is detachably coupled to the cabinet.

The module body may be detachably coupled to the cabinet, and the refrigerator further include a sealing member arranged where the module body and the cabinet are coupled to each other.

The duct module may include a fan configured to circulate air in the storeroom; a fan case having a fan inlet formed to guide air that has exchanged heat with the evaporator to the fan; and a fan cover having a cover hole formed to guide air blown by the fan to the storeroom.

The refrigerator may further include a separation plate detachably installed in the cabinet to divide the storeroom, and the duct opening may include a first duct opening arranged on one side of the separation plate and a second duct opening arranged on the other side of the separation plate.

The cabinet may form a receiving space which is opened to outside of the refrigerator when the cooling module is detached from the cabinet, and, when the cooling module is coupled to the cabinet, the cooling module may be accommodated in the receiving space.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
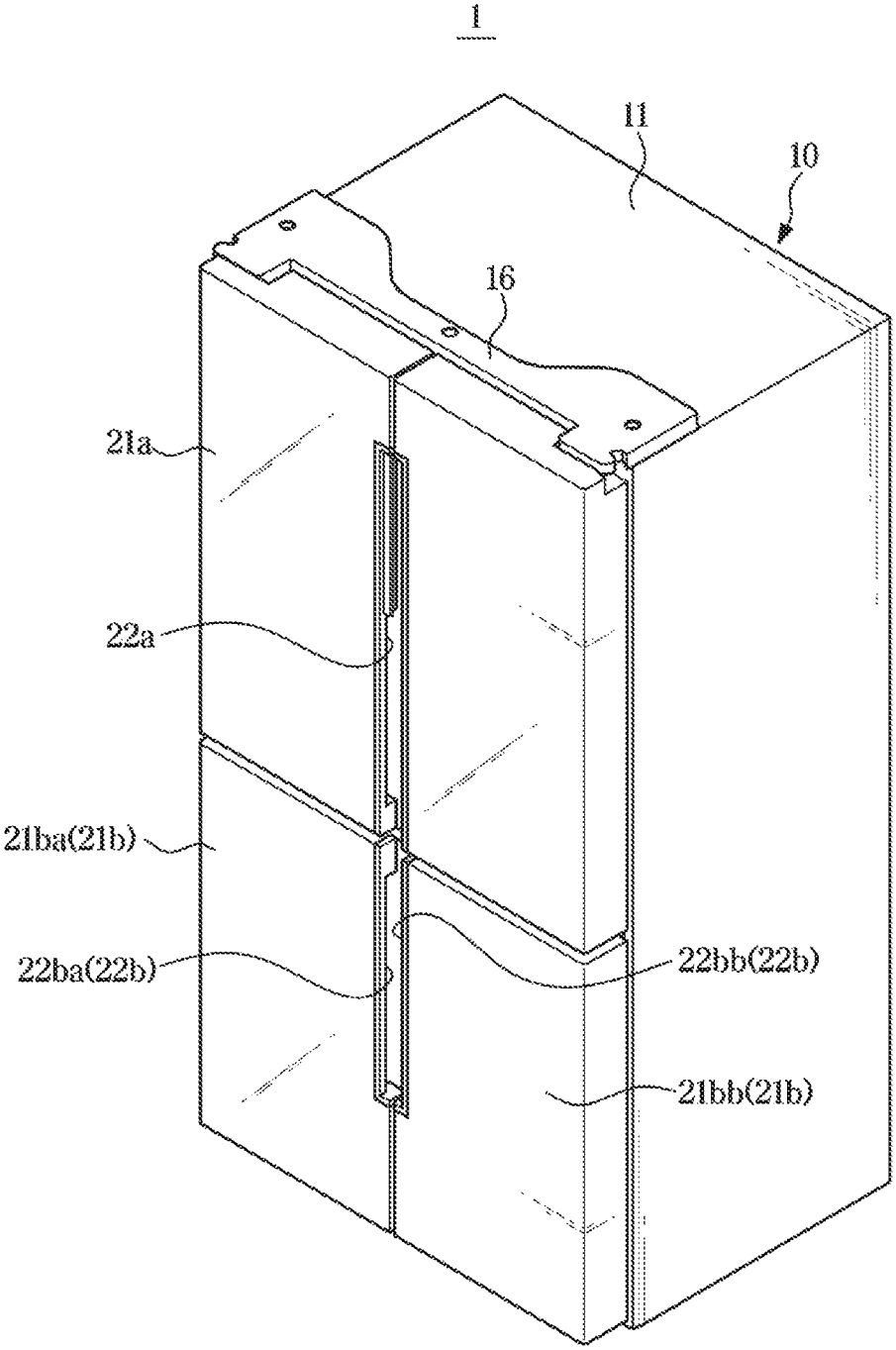
FIG. 1 shows a refrigerator, according to an embodiment of the disclosure.

Embodiments and features as described and illustrated in the disclosure are only preferred examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Reference will now be made in detail to embodiments, which are illustrated in the accompanying drawings, wherein like reference numerals refer to the like elements throughout.

Figure 2:
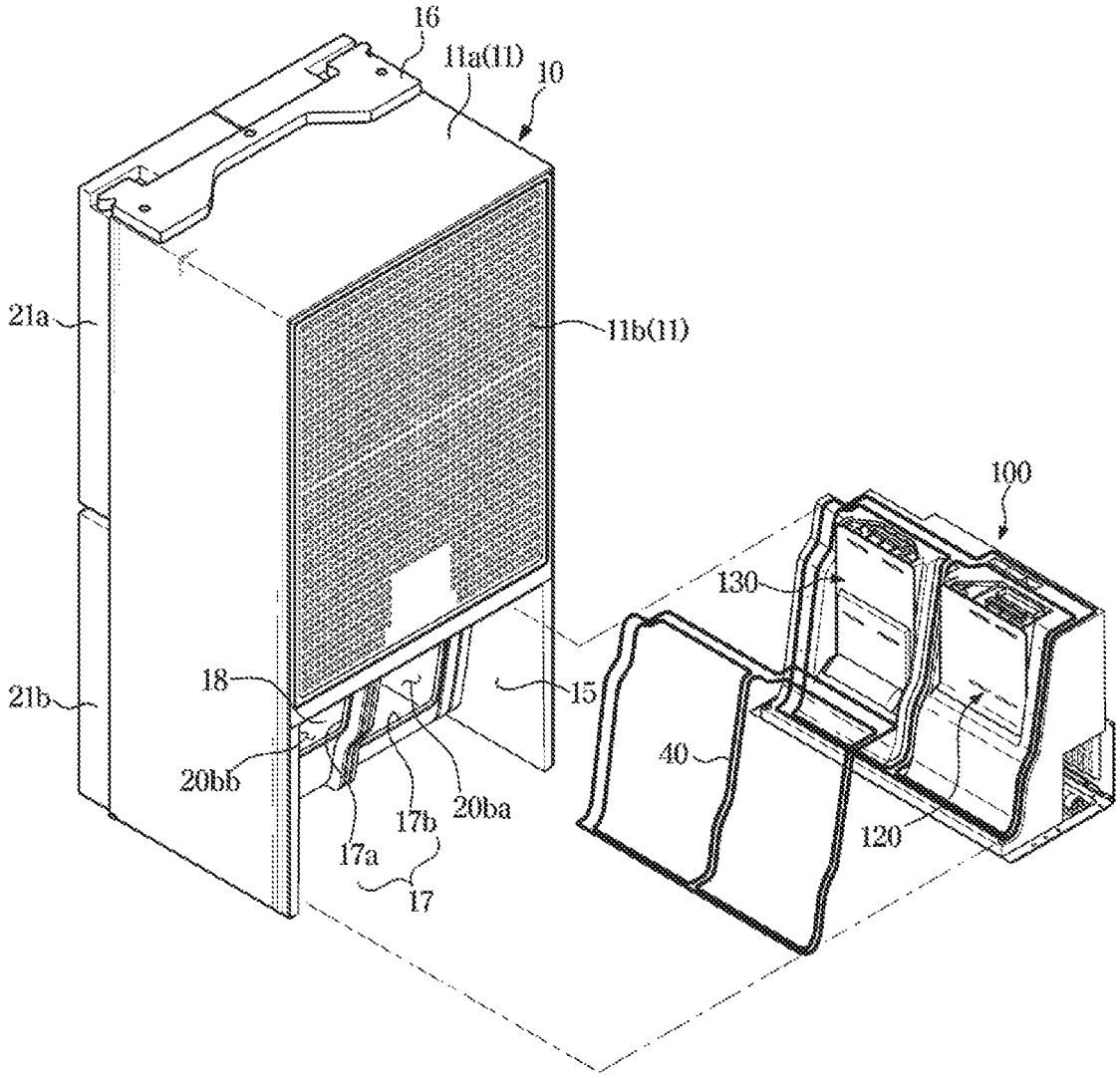
FIG. 2 shows a cooling module separated from a cabinet of the refrigerator shown in FIG. 1.
Figure 3:
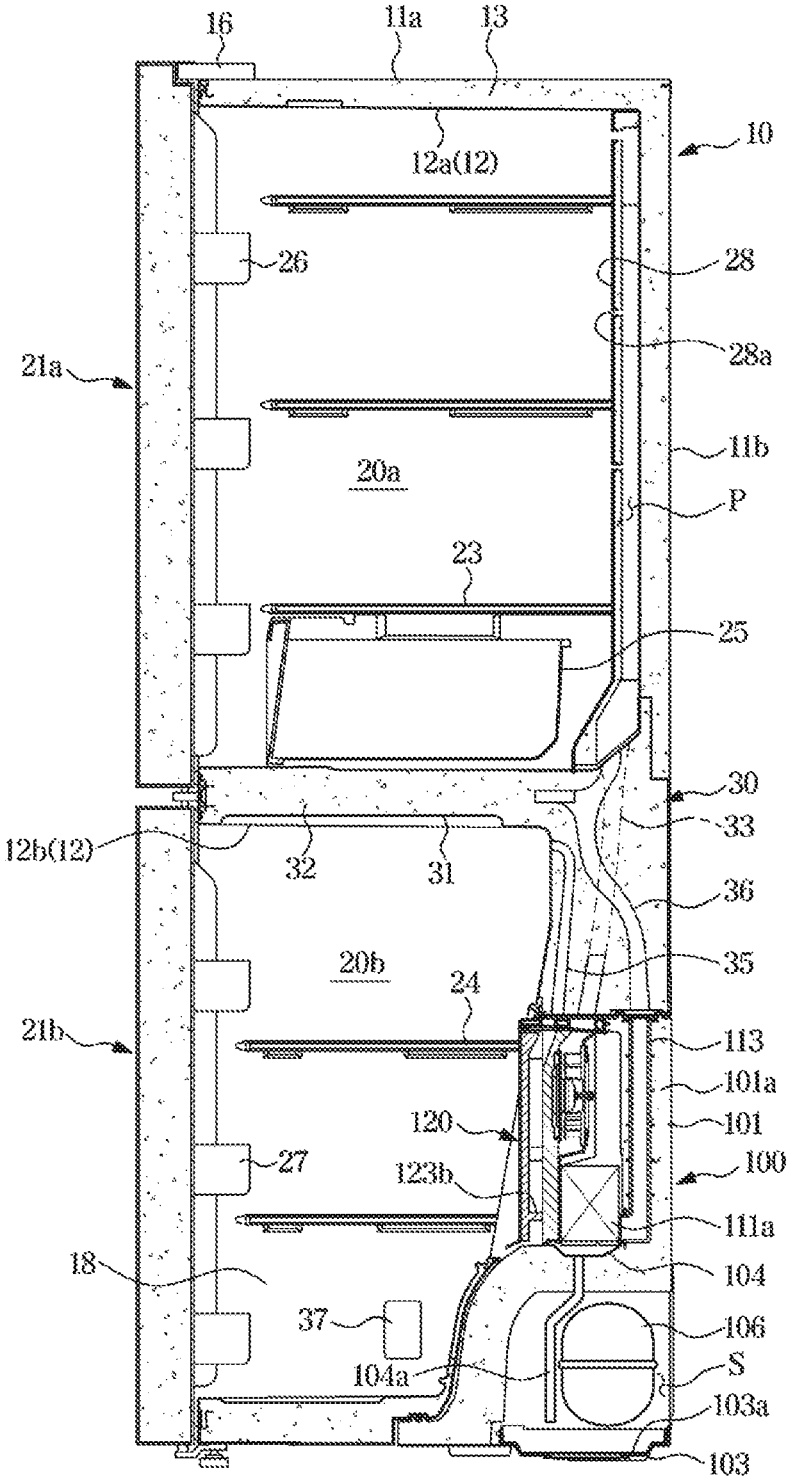
FIG. 3 is a cross-sectional view of the refrigerator shown in FIG. 1.

FIG. 1 shows a refrigerator, according to an embodiment of the disclosure. FIG. 2 shows a cooling module separated from a cabinet of the refrigerator shown in FIG. 1. FIG. 3 is a cross-sectional view of the refrigerator shown in FIG. 1.

Referring to FIGS. 1 to 3, a refrigerator 1 may include a cabinet 10 that forms storerooms 20*a* and 20*b*, doors provided to open or close the storerooms 20*a* and 20*b*, and a cooling module 100 detachably coupled to the cabinet 10 and supplying cold air into the storerooms 20*a* and 20*b*.

The cabinet 10 may include an outer case 11 and an inner case 12 coupled to the inside of the outer case 11. The outer case 11 may include a cabinet body 11*a* with its front and back open, and a cabinet cover 11*b* that covers the back of the cabinet body 11*a*. The front of the cabinet body 11*a* may be covered by the doors 21*a* and 21*b*. The outer case 11 may be formed of a metal substance.

The inner case 12 may form the storerooms 20*a* and 20*b*. The inner case 12 may be formed of a plastic substance through injection molding. The inner case 12 may include a first case 12*a* forming an upper storeroom 20*a* and a second case 12*b* forming a lower storeroom 20*b*.

A cabinet insulation 13 may be arranged between the inner case 11 and the outer case 12. The cabinet insulation 13 may use a urethane foam insulation, and use a vacuum insulation panel along with the urethane foam insulation if necessary.

The cabinet 10 may include a middle body 30 arranged between the first case 12*a* and the second case 12*b*. The middle body 30 may include a partition 31 that divides the storerooms 20*a* and 20*b* into the upper storeroom 20*a* and the lower storeroom 20*b*. The middle body 30 may include a middle body insulation 32 therein for preventing heat exchange between the upper storeroom 20*a* and the lower storeroom 20*b*. The middle body insulation 32 may be provided to prevent loss of cold air from a rear portion of the lower storeroom 20*b* to the outside.

A first cold air duct 33, a second cold air duct 34, a third cold air duct 35, and a first circulation duct 36 may be arranged inside the middle body 30. The first cold air duct 33, the second cold air duct 34, the third cold air duct 35, and the first circulation duct 36 may be arranged to pass through the middle body insulation 32.

The first cold air duct 33 may guide cold air produced from the cooling module 100 to the first storeroom 20*a*. The second cold air duct 34 may guide cold air produced from the cooling module 100 to the second storeroom 20*b*. The third cold air duct 35 may guide cold air produced from the cooling module 100 to a third storeroom 20*bb*. The first circulation duct 36 may guide air that has cooled down the first storeroom 20*a* to the cooling module 100.

The storerooms 20*a* and 20*b* may be arranged with the front open for a food item to be put in or pulled out. The storerooms 20*a* and 20*b* may include the upper storeroom 20*a* and the lower storeroom 20*b*. The upper storeroom 20*a* may be maintained at temperatures of about 0 to 5 degrees Celsius and used as a fridge to keep things cool. The upper storeroom 20*a* may also be called a first storeroom 20*a*.

Referring to FIG. 3, a guide cover 28 may be arranged in the first storeroom 20*a* to distribute the cold air supplied from the first cold air duct 33. The guide cover 28 may form a flow path P together with the first inner case 12*a*, in which the cold air supplied from the first cold air duct 33 flows.

The guide cover 28 may include a guide hole 28*a* to supply the cold air received from the first cold air duct 33 to the first storeroom 20*a*. There may be a plurality of guide holes 28*a* arranged in the vertical direction.

The lower storeroom 20*b* may include a second storeroom 20*ba* and a third storeroom 20*bb*. The cabinet 10 may include a separation plate 18 to separate the second storeroom 20*ba* from the third storeroom 20*bb*. The second storeroom 20*ba* may be maintained at temperatures of about 30 to 0 degree Celsius and used as a freezer to keep things frozen. The third storeroom 20*bb* may be used as a flexible room with changeable temperatures. However, the use of the first storeroom 20*a*, second storeroom 20*ba* and third storeroom 20*bb* may be changed as needed.

The open front of the storerooms 20*a* and 20*b* may be opened or closed by the doors 21*a* and 21*b*. Shelves 23 for food items to be put thereon and containers 25 for storing food items may be provided in the storerooms 20*a* and 20*b*.

The upper door 21*a* may be arranged to open or close the first storeroom 20*a*. The upper door 21*a* may be coupled to the cabinet 10 to be rotated in the horizontal direction. An upper door guard 26 may be arranged on the rear side of the upper door 21*a* for containing food items. An hinge cover 16 may be provided in a portion of the cabinet 10 to which the upper door 21*a* is coupled. The upper door 21*a* may also be called a first door 21*a*.

The first door 21*a* may include a first door handle 22*a*. The user may hold the first door handle 22*a* to open or close the first door 21*a*.

The lower door 21*b* may be arranged to open or close the lower storeroom 20*b*. The lower door 21*b* may be coupled to the cabinet 10 to be rotated in the horizontal direction. A lower door guard 27 may be arranged on the rear side of the lower door 21*b* for containing food items. The lower door 21*b* may include a second door 21*ba* to open or close the second storeroom 20*ba* and a third door 21*bb* to open or close the third storeroom 20*bb*.

The lower door 21*a* may include a lower door handle 22*b*. The user may hold the lower door handle 22*b* to open or close the lower door 21*b*. Specifically, the second door 21*ba* may include a second door handle 22*ba* and the third door 21*bb* may include a third door handle 22*bb*.

A cooling module installation part 15 may be arranged in a lower portion of the cabinet 10 for the cooling module 100 to be detachably installed therein. The cooling module installation part 15 may have a size and shape corresponding to that of the cooling module 100.

The cabinet 10 may include a duct opening 17. The duct opening 17 may be formed in the cooling module installation part 15. The duct opening 17 may be arranged in a portion of the cabinet 10 directed to the cooling module 100. The duct opening 17 may include a second duct opening 17*b* that links the cooling module installation part 15 to the second storeroom 20*ba*, and a first duct opening 17*a* that links the cooling module installation part 15 to the third storeroom 20*bb*. The duct opening 17 may be formed to pass through the cabinet 10.

The refrigerator 1 may include a sealing member 40 for sealing a gap between the cabinet 10 and the cooling module 100. The sealing member 40 may be arranged in the cooling module installation part 15. The sealing member 40 may be arranged in a portion of coupling between the cabinet 10 and the cooling module 100. A portion of the sealing member 40 may be arranged along and outside edges of the duct opening 17. A portion of the sealing member 40 may extend along edges of receivers 101*b* and 101*c*. The sealing member 40 may be provided in the plural.

Figure 4:
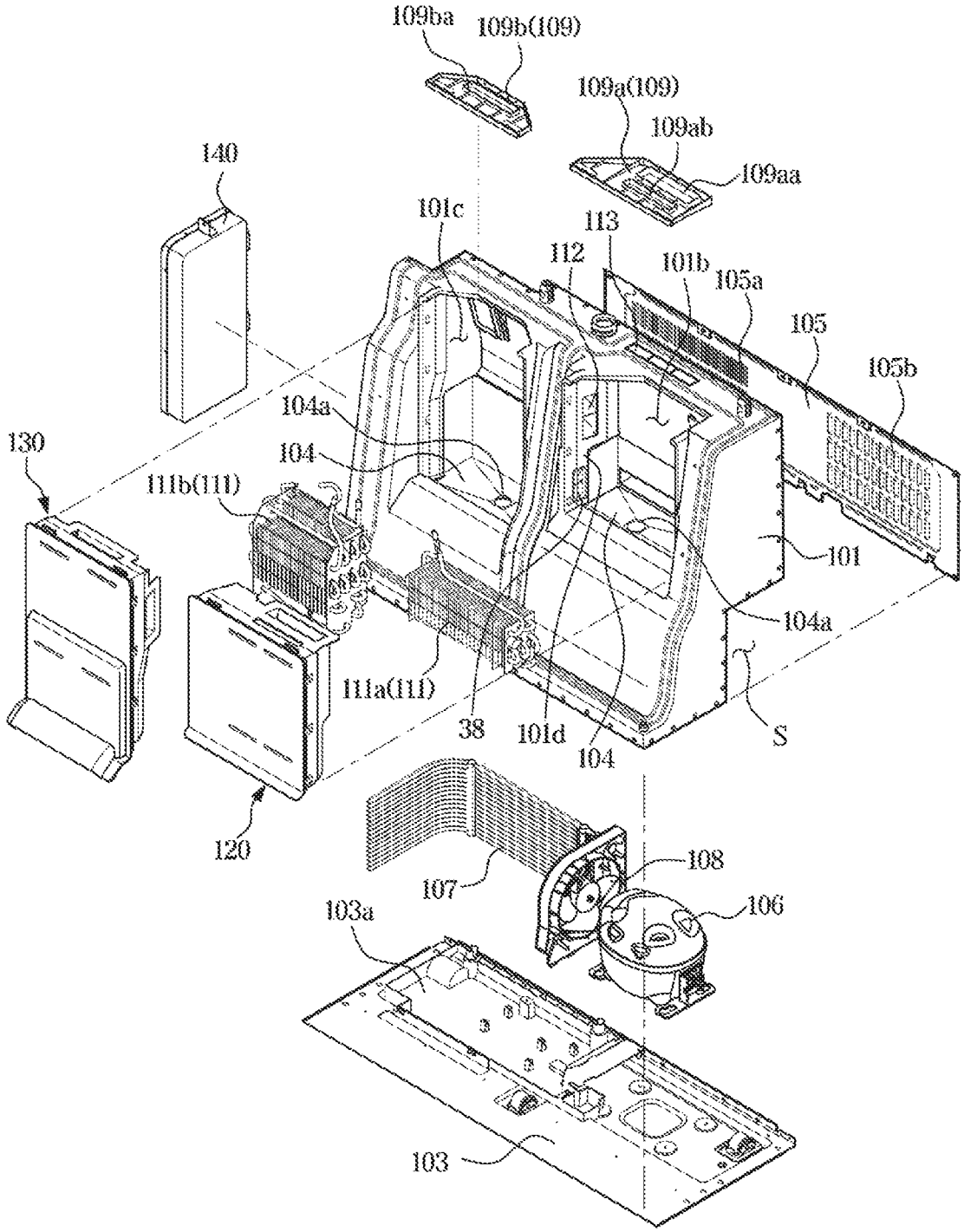
FIG. 4 is an exploded view of the cooling module shown in FIG. 2.
Figure 5:
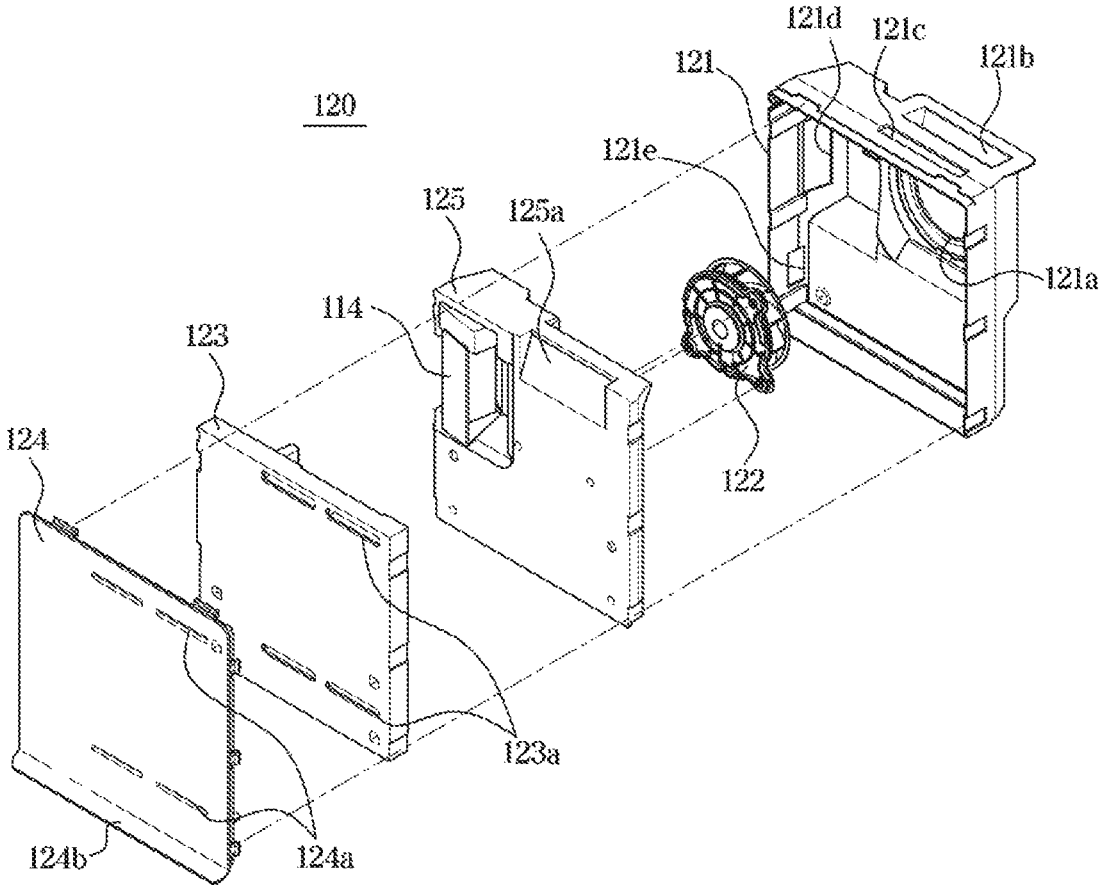
FIG. 5 is an exploded view of a first duct module shown in FIG. 4.
Figure 6:
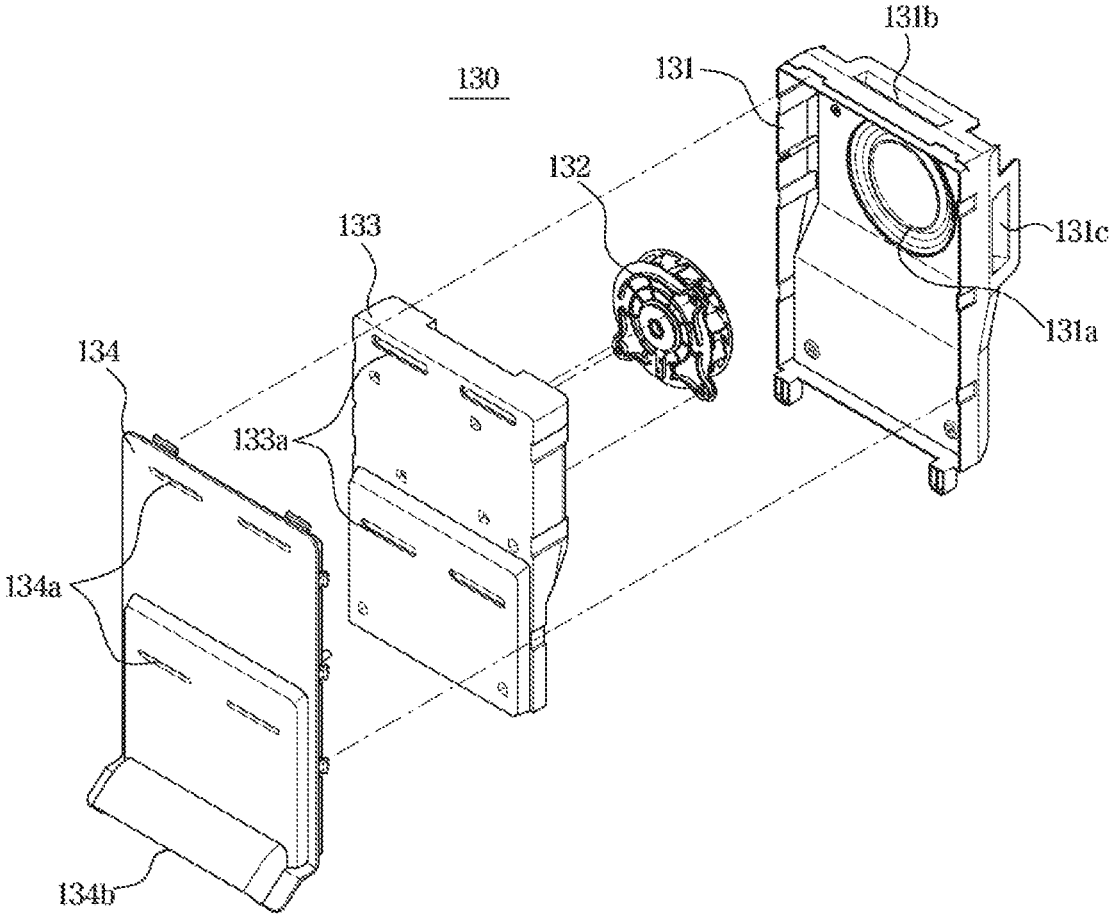
FIG. 6 is an exploded view of a second duct module shown in FIG. 4.

FIG. 4 is an exploded view of the cooling module shown in FIG. 2. FIG. 5 is an exploded view of the first duct module shown in FIG. 4. FIG. 6 is an exploded view of the second duct module shown in FIG. 4.

The cooling module 100 may generate cold air by using latent heat of a refrigerant through a cooling cycle. The cooling module 100 may have a structure to generate cold air to be supplied to the first storeroom 20*a*, second storeroom 20*ba* and third storeroom 20*bb*. The cooling module 100 may be detachably installed outside the cabinet 10.

Referring to FIG. 4, the cooling module 100 may include a module body 101, a base plate 103, a compressor 106, a condenser 107, an evaporator 111, and an expansion valve (not shown).

The module body 101 may form a portion of the back of the refrigerator 1. The module body 101 may include a module insulation 101*a* arranged therein to prevent loss of cold air generated from the evaporator 111.

The module body 101 may include the receivers 101*b* and 101*c* in which the evaporator 111 is arranged. Specifically, the receivers 101*b* and 101*c* may include the first receiver 101*b* in which a first evaporator 111*a* is arranged and the second receiver 101*c* in which a second evaporator 111*b* is arranged.

The module body 101 may include a separation wall 101*d* arranged between the first and second receivers 101*b* and 101*c*. The separation wall 101*d* may be arranged to correspond to the border between the second storeroom 20*ba* and the third storeroom 20*bb*. The module insulation 101*a* may be arranged inside the separation wall as well.

A coupling duct 112 may be provided in the separation wall 101*d* and arranged to pass through the module insulation 101*a*. The coupling duct 112 may be provided for the cold air to be supplied to the third storeroom 20*bb* to be moved. The coupling duct 112 may be arranged to link the first receiver 101*b* to the second receiver 101*c*. The coupling duct 112 may have one end coupled to a first fan coupling hole 121*d* and the other end coupled to a second fan coupling hole 131*c*.

A third circulation duct 38 may be provided in the separation wall 101*d* and arranged to pass through the module insulation 101*a*. The third circulation duct 38 may be arranged for air that has cooled down the third storeroom 20*bb* to be moved to the second evaporator 111*b*. The third circulation duct 38 may be arranged to link the first receiver 101*b* to the second receiver 101*c*. The third circulation duct 38 may be arranged to link a portion of the space between the separation cover 125 and the first fan cover 123 to the space where the second evaporator 111*b* is arranged.

A guide duct 113 may be provided in the module body 101. The guide duct 113 may be arranged to pass through the module insulation 101*a* of the module body 101. The guide duct 113 may be coupled to the first circulation duct 36. The guide duct 113 may link the first circulation duct to the first receiver 101*b* where the first evaporator 111*a* is arranged.

The base plate 103 may be arranged at the bottom of the module body 101. The base plate 103 may cover the bottom of the module body 101. The compressor 106 may be fixed to the base plate 103. The condenser 107 may be fixed to the base plate 103. A cooling fan 108 may be fixed to the base plate 103.

A water collecting pan 103*a* may be arranged on the base plate 103. The water collecting pan 103*a* may collect condensate water formed from the condenser 107 and/or the evaporator 111. The condenser 107 may be arranged above the water collecting pan 103*a*.

The module body 101 may include a drain pan 104 for guiding the condensate water formed from the evaporator 111 to the water collecting pan 103, and a drain pipe 104*a*. The drain pan 104 may be arranged underneath the evaporator 111. Specifically, the drain pan 104 may be arranged underneath each of the first evaporator 111*a* and the second evaporator 111*b*. The drain pan 104 may be arranged in each of the first and second receivers 101*b* and 101*c*.

The drain pipe 104*a* may be arranged to guide the condensate water collected on the drain pan 104 to the water collecting pan 103*a*. At least a portion of the drain pipe 104*a* may pass through the module insulation 101*a*.

An electronics box 140 may be arranged on the base plate 103. The electronics box 140 may be arranged on a side on which the second receiver 101*c* is arranged. The electronics box 140 may control the cooling module 100 to change temperatures in the storerooms 20*a* and 20*b*. The electronics box 140 may receive power to drive the refrigerator 1.

The module cover 105 may cover a rear bottom portion of the module body 101. Together with the base plate 103, the module cover 105 may cover the machine room S arranged in the lower portion of the module body 101 such that the compressor 106, the condenser 107 and the cooling fan 108 may be arranged therein. The module cover 105 may include a cover inlet 105*a* through which outside air flows in by the cooling fan 108 and a cover outlet 105*b* through which the air flows out.

The compressor 106 may compress refrigerants and move them to the condenser 107. The condenser 107 may condense the refrigerants and move them to the expansion valve. The cooling fan 108 may cool down the compressor 106 and the condenser 107. As the cooling fan 108 is driven, air flows into the machine room S through the cover inlet 105*a*, exchanges heat with the condenser 107 and the compressor 106, and flows out of the machine room S through the cover outlet 105*b*.

The module body 101, the base plate 103, and the module cover 105 may be collectively called a module housing.

The evaporator 111 may be configured to produce cold air. The evaporator 111 may be arranged in the receivers 101*b* and 101*c*. The evaporator 111 may include a first evaporator 111*a* and a second evaporator 111*b*. The first evaporator 111*a* may be arranged in the first receiver 101*b*. The second evaporator 111*b* may be arranged in the second receiver 101*c*.

The cooling module 100 may include a cap to cover the open top of the receivers 101*b* and 101*c*. The cap 109 may include a first cap 109*a* to cover the top of the first receiver 101*b*, and a second cap 109*b* to cover the top of the second receiver 101*c*.

The first cap 109*a* may be arranged on top of the first duct module 120. The first cap 109*a* may include a cap hole 1*a* 109*aa* arranged to correspond to a fan outlet 1*a* 121*b* formed at a first fan case 121, and a cap hole 1*b* 109*ab* arranged to correspond to a fan outlet 1*b* 121*c* formed at the first fan case 121. The cap hole 1*a* 109*aa* may be formed to be linked to the first cold air duct 33. The cap hole 1*b* 109*ab* may be formed to be linked to the third cold air duct 35.

The second cap 109*a* may be arranged on top of the second duct module 130. The second cap 109*b* may include a second cap hole 109*ba* arranged to correspond to a second fan outlet 131*b* formed at a second fan case 131. The second cap hole 109*ba* may be formed to be linked to the second cold air duct 34.

The duct modules 120 and 130 may be arranged in the receivers 101*b* and 101*c* for moving the cold air produced by the evaporator 111 to the storerooms 20*a* and 20*b*. The duct modules 120 and 130 may include the first duct module 120 arranged in the first receiver 101*b*, and the second duct module 130 arranged in the second receiver 101*c*.

Specifically, referring to FIGS. 5 and 6, the first duct module 120 may include the first fan case 121, a first fan 122, the first fan cover 123, a first duct cover 124, and a separation cover 125.

The first fan case 121 may be arranged to cover the first fan 122. The first fan case 121 may be detachably coupled to the first receiver 101*b*. The first fan case 121 may be fixed to the module body 101.

The first fan case 121 may include a first fan inlet 121*a* through which the air that has exchanged heat with the first evaporator 111*a* flows in The first fan inlet 121*a* may be formed on the back of the first fan case 121.

The first fan case 121 may include a fan outlet 1*a* 121*b* that is linked to the first cold air duct 33. The fan outlet 1*a* 121*b* may discharge cold air to be supplied to the first storeroom 20*a*. The fan outlet 1*a* 121*b* may be formed on the top of the first fan case 121.

The first fan case 121 may include a fan outlet 1*b* 121*c* that is linked to the third cold air duct 35. The fan outlet 1*b* 121*c* may discharge cold air to be supplied to the third storeroom 20*bb*. The fan outlet 1*b* 121*c* may be formed on the top of the first fan case 121.

The first fan case 121 may include a first fan coupling hole 121*d* that is linked to the coupling duct 112. The first fan coupling hole 121*d* may be formed for the air blown by the second fan 132 to flow in The first fan coupling hole 121*d* may be formed for the cold air to be supplied to the third storeroom 20*bb* to flow in The first fan coupling hole 121*d* may be formed on a side of the first fan case 121. The first fan case 121 may include a first fan circulation hole 121*e* that is linked to the third circulation duct 38. The first fan circulation hole 121*e* may be arranged to guide the air that has cooled down the third storeroom 20*bb* to the second evaporator 111*b*. The first fan circulation hole 121*e* may discharge the air that has flown into the first duct module 120 through the first duct circulation hole 127 to the second receiver 101*c* where the second evaporator 111*b* is arranged.

The first fan circulation hole 121*e* may be formed on a side of the first case 121, which is directed to the separation wall 101*d*.

The first fan 122 may be driven to supply the air that has exchanged heat with the first evaporator 111*a* to the first storeroom 20*a*. The first fan 122 may be arranged in the first receiver 101*b*. The first fan 122 may be fixed to the separation cover 125.

The first fan cover 123 may be coupled to the front of the first fan case 121. The separation cover 125 may be arranged between the first fan cover 123 and the first fan case 121.

Referring to FIG. 3, a separation rib 123*b* may be arranged on the back of the first fan cover 123 to divide space between the separation cover 125 and the first fan cover 123. The space between the first fan cover 123 and the separation cover 125 may be divided by the separation rib 123*b* into a space for receiving air from the coupling duct 112 and a space for collecting the air that has cooled down the third storeroom 20*bb*.

The separation cover 125 may cover the front of the first fan case 121. The separation cover 125 may divide space formed between the first fan case 121 and the first fan cover 123. The separation cover 125 may form a space with the first fan case 121, in which the cold air to be supplied to the first storeroom 20*a* flows. The separation cover 125 may form a space with the first fan cover 123, in which the cold air to be supplied to the third storeroom 20*a* flows. A flow path is formed behind the separation cover 125 for the air that has exchanged heat with the first evaporator 111*a* to flow, and a flow path is formed in front of the separation cover 125 for the air that has exchanged heat with the second evaporator 111*b* to flow. A flow path is formed behind the separation cover 125 for the air moved by the first fan 122 to flow, and a flow path is formed in front of the separation cover 125 for the air moved by the second fan 122 to flow.

The separation cover 125 may prevent the air that has exchanged heat with the first evaporator 111*a* from being mixed with the air that has exchanged with the second evaporator 111*b*. The separation cover 125 may prevent the air moved by the first fan 122 from being mixed with the air moved by the second fan 132. The separation cover 125 may support the first fan 122.

The separation cover may include a hole forming part 125*a* for making a hole linked to the third cold air duct 35, when coupled to the first fan cover 123. The hole forming part 125*a* may be formed in an upper portion of the separation cover 125.

A coupling duct damper 114 may be arranged on the separation cover 125 to regulate an amount of cold air that passes the coupling duct 112. Depending on the extent to which the coupling duct damper 114 is opened, temperature in the third storeroom 20*bb* may be regulated.

The first fan cover 123 may be arranged in front of the separation cover 125. The first fan cover 123 may form a space together with the separation cover 125, in which the cold air to be supplied to the third storeroom 20*bb* flows. The first fan cover 123 may be detachably mounted onto the first fan case 121.

The first fan cover 123 may include a first cover hole 123*a* linked to the third storeroom 20*bb*. The first cover hole 123*a* may be formed to discharge some of the air flowing in through the coupling duct 112 to the third storeroom 20*bb*. Some of the air flowing in through the coupling duct 112 may be moved to the third cold air duct 35 and supplied to the third storeroom 20*bb*, and the others may be supplied to the third storeroom 20*bb* through the first cover hole 123*a*.

The first duct cover 124 may be arranged in front of the first fan cover 123. The first duct cover 124 may cover the front of the first fan cover 123. The first duct cover 124 may include a first duct hole 124*a* linked to the third storeroom 20*bb*. The first duct hole 124*a* may be formed to correspond to the first cover hole 123*a*. Some of the cold air blown by the second fan 132 may be supplied to the third storeroom 20*bb* through the first cover hole 123*a* and the first duct hole 124*a*.

The first duct cover 124 may include a first duct inlet 124*b*. The first duct inlet 124*b* may be arranged to be separated from the module body 101 by a certain distance. The first duct inlet 124*b* may form the first duct circulation hole 127 together with the module body 101. The air that has cooled down the third storeroom 20*bb* may be collected into the first duct module 120 through the first duct circulation hole 127. The air collected through the first duct circulation hole 127 may be guided through the third circulation duct 38 to the second evaporator 111*b*.

The second duct module 130 may include the second fan case 131, the second fan 132, a second fan cover 133, and a second duct cover 134.

The second fan case 131 may be arranged in the second receiver 101*c*. The second fan case 131 may include a second fan inlet 131*a* through which the air that has exchanged heat with the second evaporator 111*b* flows in The second fan inlet 131*a* may be formed on the back of the second fan case 131.

The second fan case 131 may include a second fan outlet 131*b* that is linked to the second cold air duct 34. The second fan outlet 131*b* may discharge cold air to be supplied to the second storeroom 20*ba*. The second fan outlet 131*b* may be formed on the top of the second fan case 131.

The second fan case 131 may include a second fan coupling hole 131*c* that is linked to the coupling duct 112. The second fan coupling hole 131*c* may be formed to discharge the air blown by the second fan 132 to the coupling duct 112. The second fan coupling hole 131*c* may be formed to discharge the cold air to be supplied to the third storeroom 20*bb*. The second fan coupling hole 131*c* may be formed on a side of the second fan case 131.

The second fan 132 may be driven to supply the air that has exchanged heat with the second evaporator 111*b* to the second and third storerooms 20*ba* and 20*bb*. The second fan 132 may be arranged in the second receiver 101*c*. The second fan 132 may be fixed to the second fan cover 133.

The second fan cover 133 may be coupled to the front of the second fan case 131. The second fan cover 133 may cover the front of the second fan case 131. The second fan cover 133 may form a space together with the second fan case 131, in which the cold air to be supplied to the second and third storerooms 20*ba* and 20*bb* flows. The second fan cover 133 may be fixed to the second fan case 131.

The second fan cover 133 may include a second cover hole 133*a* linked to the second storeroom 20*ba*. The second cover hole 133*a* may be formed to discharge some of the air blown by the second fan 132 to the second storeroom 20*ba*. Some of the air blown by the second fan 132 may be moved to the second cold air duct 34 and supplied to the second storeroom 20*ba*, and the others may be supplied to the second storeroom 20*ba* through the second cover hole 133*a*. The second fan cover 133 may support the second fan 132.

The second duct cover 134 may be arranged in front of the second fan cover 133. The second duct cover 134 may cover the front of the second fan cover 133.

The second duct cover 134 may include a second duct hole 134*a* linked to the second storeroom 20*ba*. The second duct hole 134*a* may be formed to correspond to the second cover hole 133*a*. Some of the cold air blown by the second fan 132 may be supplied to the second storeroom 20*ba* through the second cover hole 133*a* and the second duct hole 134*a*.

The second duct cover 134 may include a second duct inlet 134*b*. The second duct inlet 134*b* may be arranged to be separated from the module body 101 by a certain distance. The second duct inlet 134*b* may form a second duct circulation hole 137 together with the module body 101. The air that has cooled down the second storeroom 20*ba* may be collected into the second duct module 130 through the second duct circulation hole 137. The air collected through the second duct circulation hole 137 may be guided to the second evaporator 111*b*.

With this structure, the refrigerator according to an embodiment of the disclosure may allow cooling performance test to be performed before the cooling module 100 is installed at the cabinet 10 because all the components of the cold air supply system may be arranged in the cooling module 100 and the cooling module 100 may be detachably installed at the cabinet 10. Furthermore, when the cold air supply system needs to be maintained or repaired, the cooling module 100 may be removed from the cabinet 10 for maintenance or repair, making it easy to maintain and repair the refrigerator 1.

Figure 7:
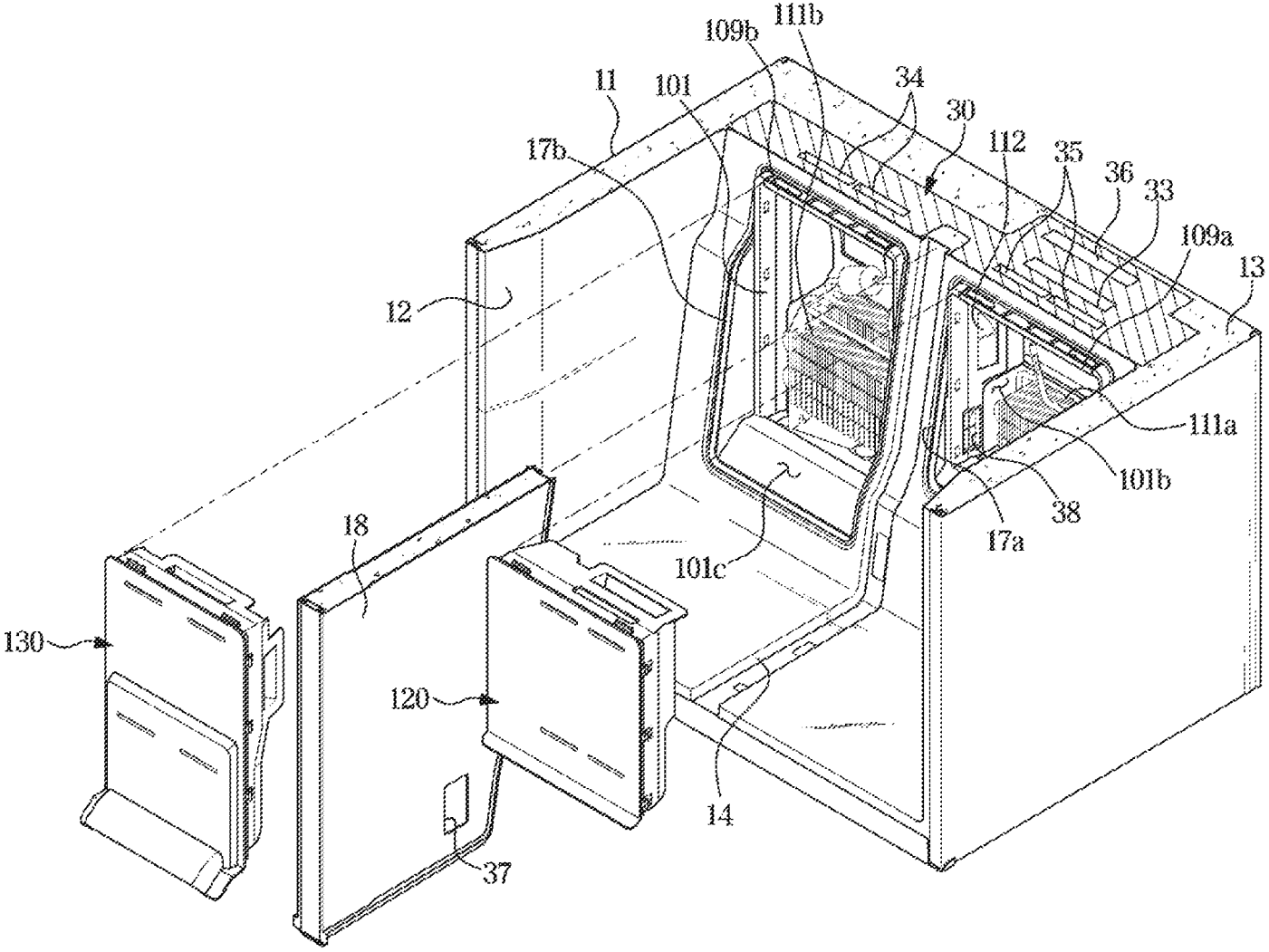
FIG. 7 shows a separation plate separated from the cabinet and a duct module separated through a duct opening while the cooling module is installed at the cabinet as shown in FIG. 2.
Figure 8:
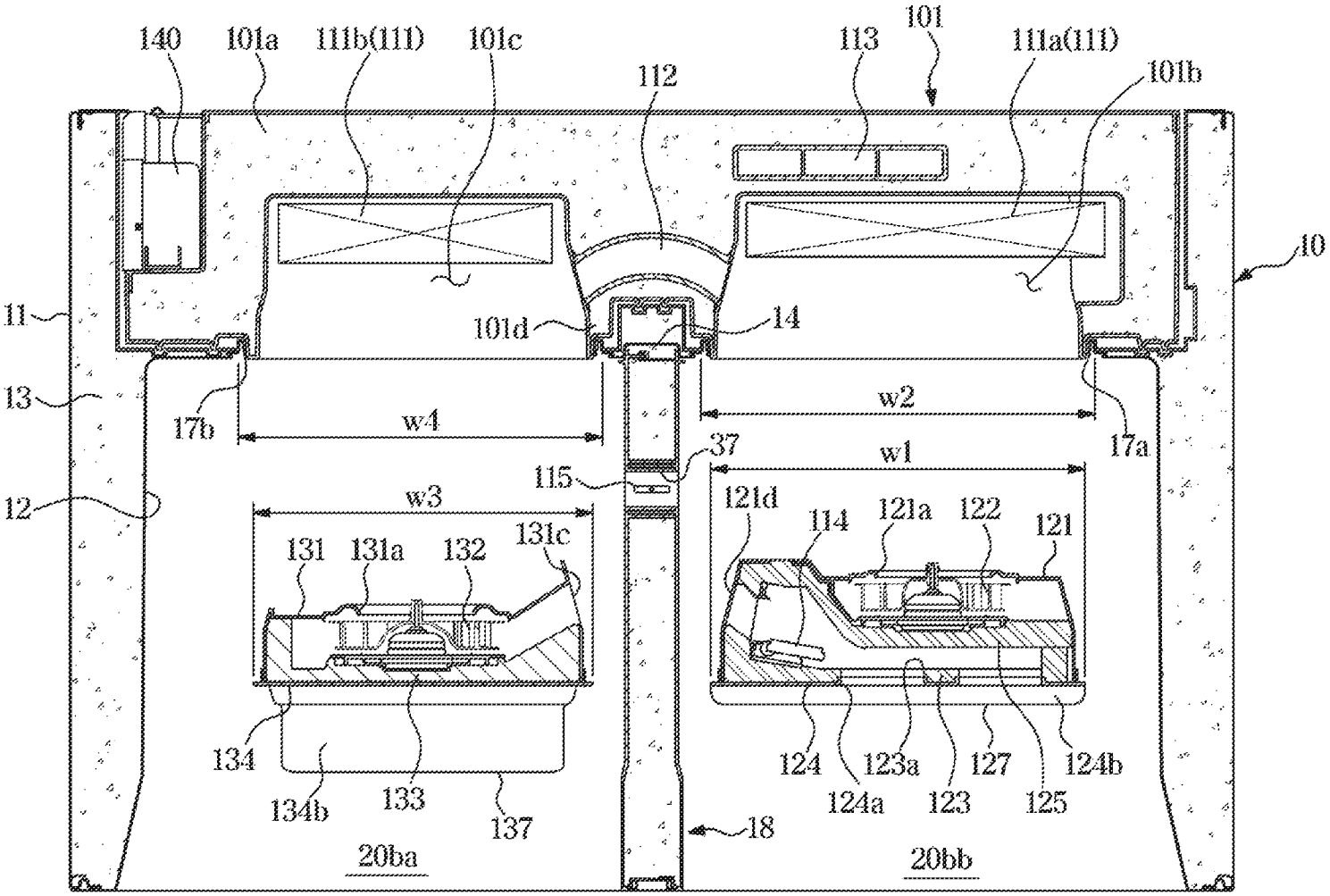
FIG. 8 is a cross section viewed from above of the duct module being separated through the duct opening while the cooling module is installed at the cabinet as shown in FIG. 2.
Figure 9:
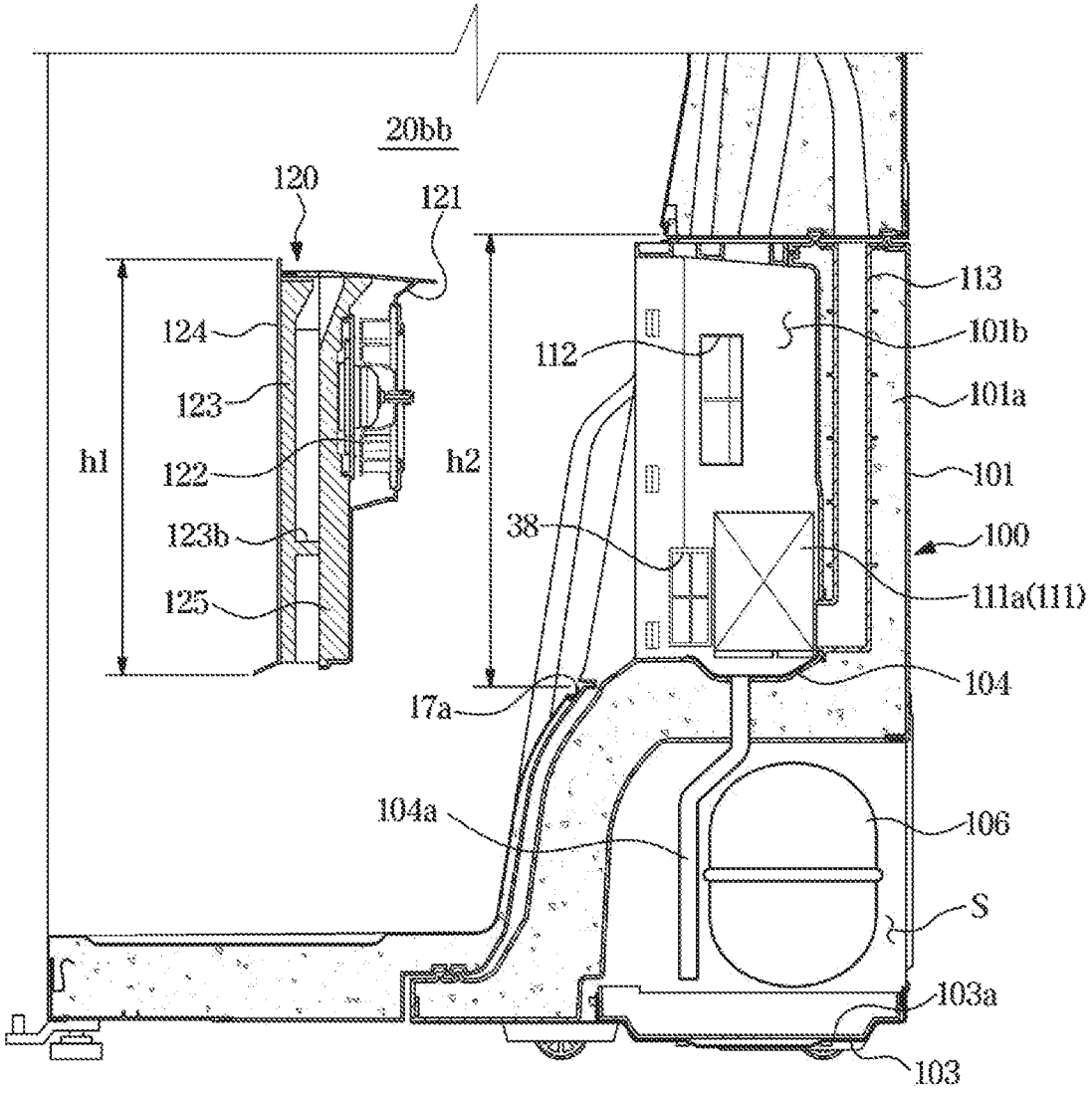
FIG. 9 is a cross section viewed from a side of the first duct module being separated through a first duct opening while the cooling module is installed at the cabinet as shown in FIG. 2.
Figure 10:
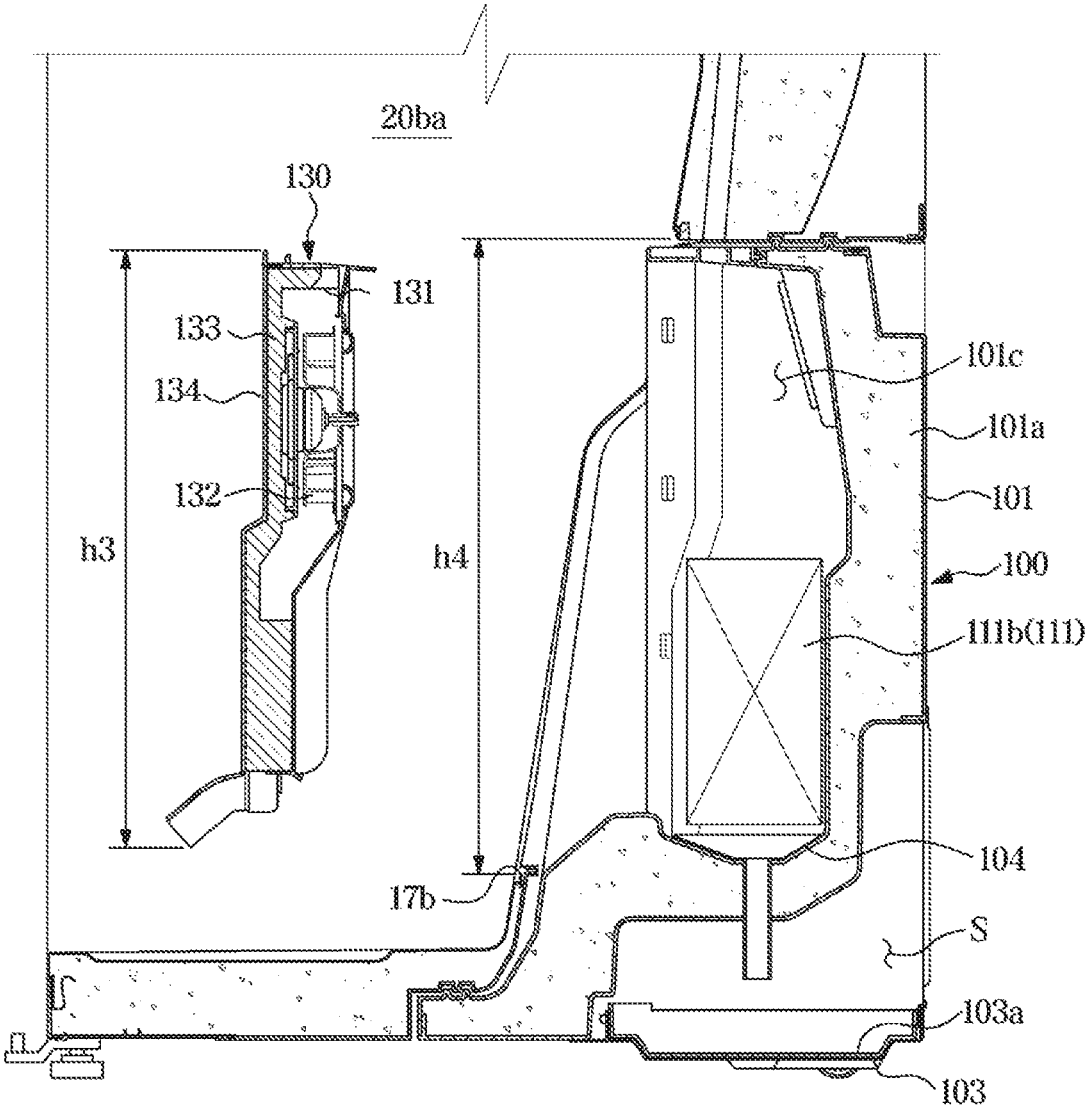
FIG. 10 is a cross section viewed from a side of the second duct module being separated through a second duct opening while the cooling module is installed at the cabinet as shown in FIG. 2.

FIG. 7 shows a separation plate separated from the cabinet and a duct module separated through a duct opening while the cooling module is installed at the cabinet as shown in FIG. 2. FIG. 8 is a cross section viewed from above of the duct module being separated through the duct opening while the cooling module is installed at the cabinet as shown in FIG. 2. FIG. 9 is a cross section viewed from a side of the first duct module being separated through a first duct opening while the cooling module is installed at the cabinet as shown in FIG. 2. FIG. 10 is a cross section viewed from a side of the second duct module being separated through a second duct opening while the cooling module is installed at the cabinet as shown in FIG. 2.

Referring to FIG. 7, while the cooling module 100 is installed at the cabinet 10, the duct module 120 and 130 may be separated into the lower storeroom 20*b* through the duct opening 17. Specifically, the duct module 120 and 130 may be mounted outside the cabinet 10 while being installed in the cooling module 100, and when installed at the cabinet 10, may be separated into the lower storeroom 20*b* through the duct opening 17.

For this, the duct opening 17 may be formed for the duct module 120 and 130 to pass through. The first duct module 120 may pass through the first duct opening 17*a*, and the second duct module 130 may pass through the second duct opening 17*b*. The first duct opening 17*a* may be formed at a position corresponding to the first duct module 120, and the second duct opening 17*b* may be formed at a position corresponding to the second duct module 130. The duct opening 17 may be formed to penetrate the cabinet 10 for the duct module 120 and 130 to pass through.

When the duct module 120 and 130 is separated from the cooling module 100, the evaporator 111 may be exposed to the outside. When the first duct module 120 is separated from the module body 101, the first evaporator 111*a* arranged in the first receiver 101*b* may be in a state of being accessible through the lower storeroom 20*b*. When the second duct module 130 is separated from the module body 101, the second evaporator 111*b* arranged in the second receiver 101*c* may be in a state of being accessible through the lower storeroom 20*b*.

The separation plate 18 may divide the lower storeroom 20*b* into the second storeroom 20*ba* and the third storeroom 20*bb*. The separation plate 18 may have insulation therein. The separation plate 18 may be detachably mounted onto the cabinet 10. When the user intends to divide the lower storeroom 20*b*, the separation plate 18 may be mounted onto a separation plate installation part 14 formed in the inner case 12 of the cabinet 10. When a user intends to use the lower storeroom 20*b* as a whole, the separation plate 18 may be removed from the inner case 12 of the cabinet 10.

The separation plate 18 may include a second circulation duct 37. The second circulation duct 37 may be arranged to pass through the separation plate 18. The second circulation duct 37 may link the second storeroom 20*ba* to the third storeroom 20*bb*. Some of the air that has cooled down the third storeroom 20*bb* may be moved to the second storeroom 20*ba* through the second circulation duct 37. The air moved to the second storeroom 20*ba* may be collected into the cooling module 100 along with the air that has cooled down the second storeroom 20*ba*.

Referring to FIG. 8, the width w1 of the first duct module 120 may be less than the width w2 of the first duct opening 17*a*. The width w3 of the second duct module 130 may be less than the width w4 of the second duct opening 17*b*. The width w1 of the first duct module 120 and the width w3 of the second duct module 130 may or may not be the same. The width w2 of the first duct opening 17*a* and the width w4 of the second duct opening 17*b* may or may not be the same.

The cooling module 100 may include a circulation duct damper 115 to regulate an amount of air that passes the second circulation duct 37. Depending on the extent to which the circulation duct damper 115 is opened, temperature in the third storeroom 20*bb* may be changed. The circulation duct damper 115 may be arranged inside the second circulation duct 37.

Referring to FIGS. 9 and 10, the height h1 of the first duct module 120 may be less than the height h2 of the first duct opening 17*a*. The height h3 of the second duct module 130 may be less than the height h4 of the second duct opening 17*b*. The height h1 of the first duct module 120 and the height h3 of the second duct module 130 may or may not be the same. The height h2 of the first duct opening 17*a* and the height h4 of the second duct opening 17*b* may or may not be the same.

With this structure, the refrigerator 1 may be easily maintained or repaired by allowing the duct module 120 and 130 to be taken apart through the lower storeroom 20*b* without disassembling the cabinet 10. When the evaporator 111 in the refrigerator 1 needs to be maintained or repaired, the maintenance and repair may be easily performed by taking the duct module 120 and 130 apart without the need to separate the cooling module 100 from the cabinet 10.

Figure 11:
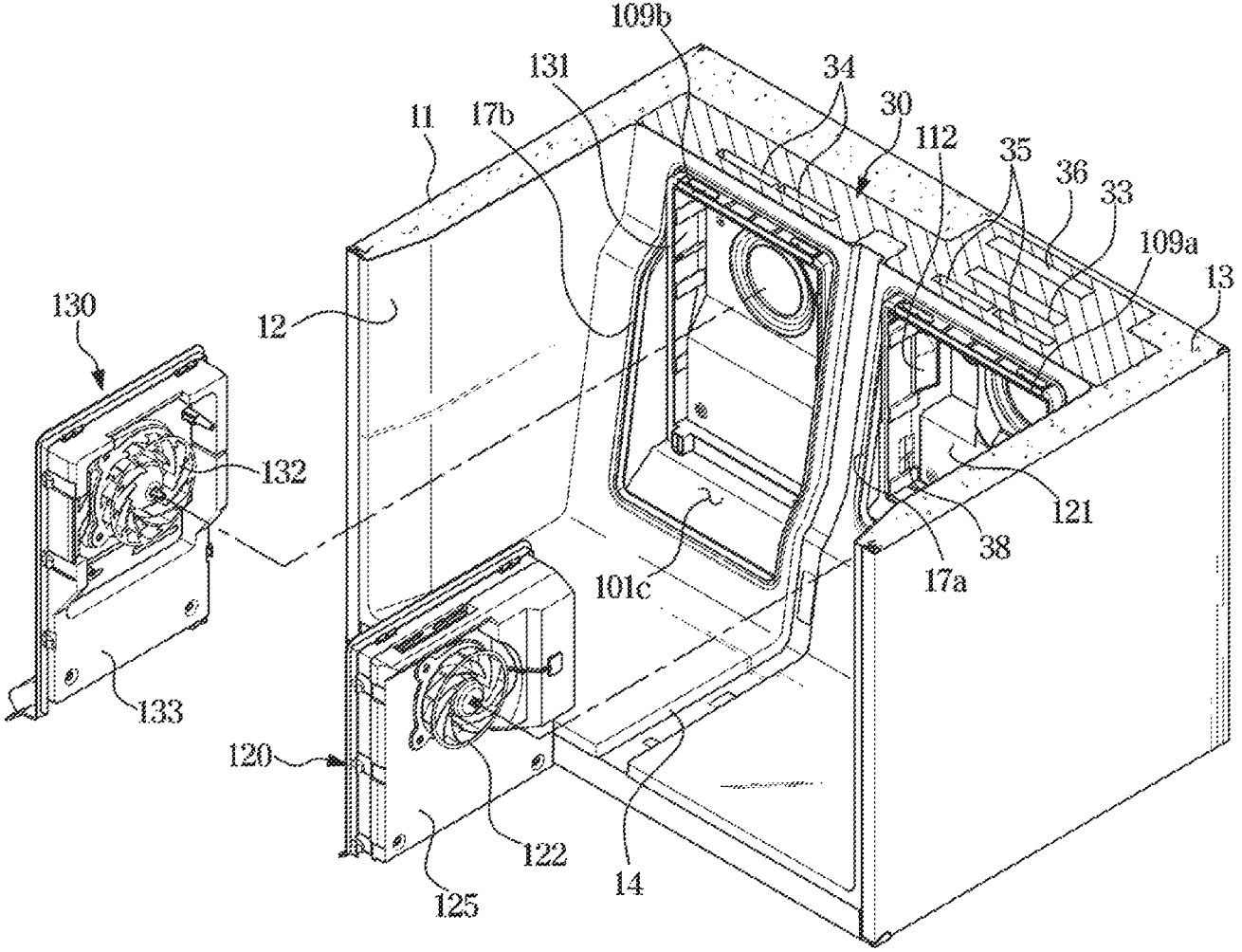
FIG. 11 shows the duct module being separated through the duct opening except a fan case while the cooling module is installed at the cabinet as shown in FIG. 2.

FIG. 11 shows the duct module being separated through the duct opening except a fan case while the cooling module is installed at the cabinet as shown in FIG. 2.

Referring to FIG. 11, the first duct module 120 exclusive of the first fan case 121 may be separated from the cooling module 100. A worker may separate the first fan 122, the first fan cover 123, the first duct cover 124, and the separation cover 125 from the module body 101 through the lower storeroom 20*b*.

The second duct module 130 exclusive of the second fan case 131 may be separated from the cooling module 100. The worker may separate the second fan 132, the second fan cover 133, and the second duct cover 134 from the module body 101 through the lower storeroom 20*b*.

With this structure, when an internal part of the duct module 120 and 130, for example, the fan 122 and 132, needs to be maintained or repaired, the maintenance and repair may be easily performed by taking the part of the duct module 120 and 130 apart through the lower storeroom 20*b* without the need to separate the cooling module 100 from the cabinet 10.

Figure 12:
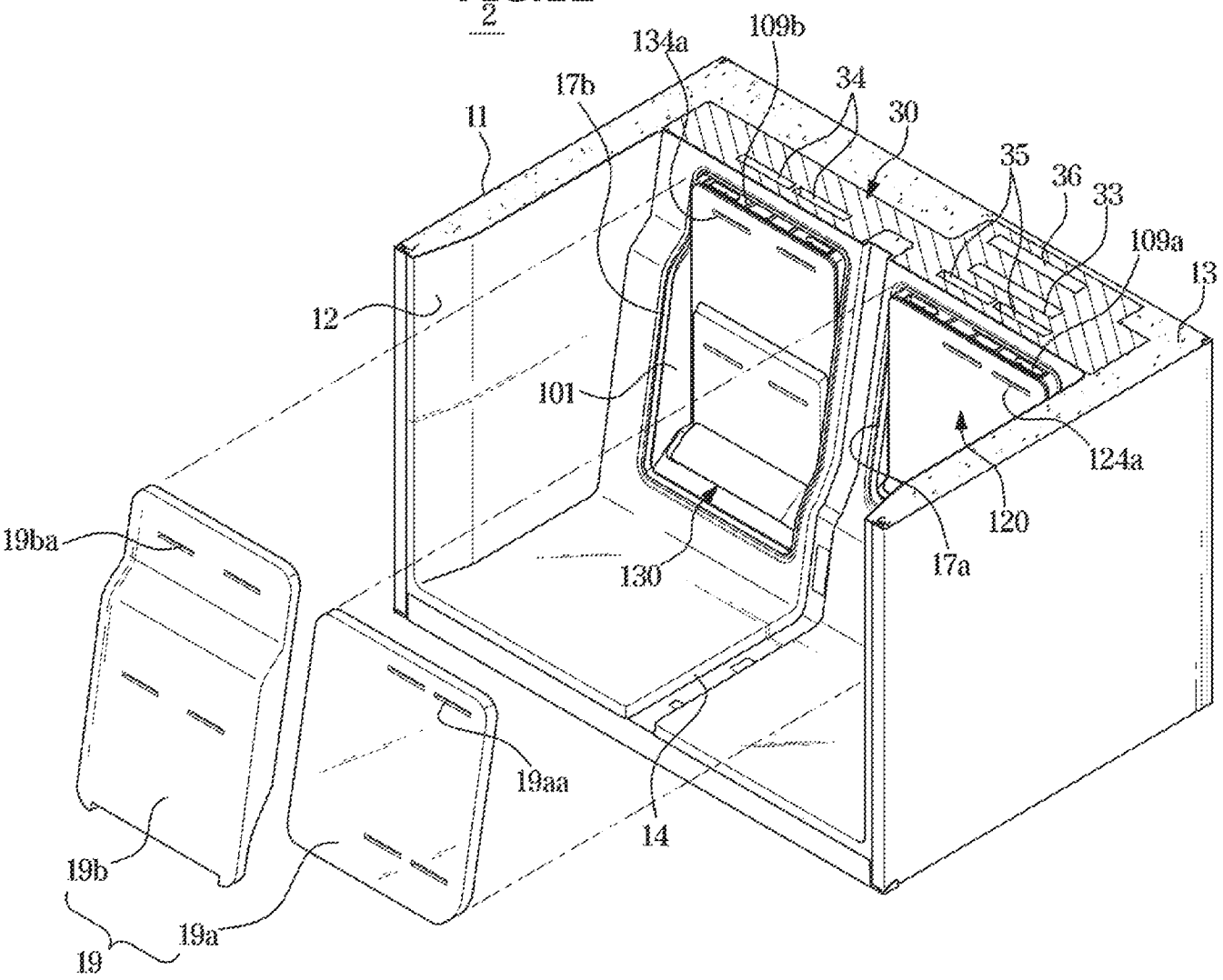
FIG. 12 shows a storeroom cover separated from a cabinet in a refrigerator, according to another embodiment of the disclosure.

FIG. 12 shows a storeroom cover separated from a cabinet in a refrigerator, according to another embodiment of the disclosure.

Referring to FIG. 12, a storeroom cover 19 of a refrigerator will be described. The same parts as those in FIGS. 1 to 11 will have the same reference numerals, and the detailed description thereof will not be repeated.

Referring to FIG. 12, the refrigerator 2 may include the storeroom cover 19 arranged to cover the duct opening 17. The storeroom cover 19 may include a first storeroom cover 19*a* for covering the first duct opening 17*a* and a second storeroom cover 19*b* for covering the second duct opening 17*b*.

The first storeroom cover 19*a* may include a first cover opening 19*aa* formed to correspond to the first duct hole 124*a*. The first cover opening 19*aa* may guide the cold air discharged through the first duct hole 124*a* of the first duct module 120 to the third storeroom 20*bb*.

The second storeroom cover 19*b* may include a second cover opening 19*ba* formed to correspond to the second duct hole 134*a*. The second cover opening 19*ba* may guide the cold air discharged through the second duct hole 134*a* of the second duct module 130 to the second storeroom 20*ba*.

While installed at the cabinet 10, the storeroom cover 19 may cover the first and second duct modules 120 and 130 of the cooling module 100 such that the first and second duct modules 120 and 130 are not seen through the storeroom.

The storeroom cover 19 may form a portion of the rear wall of the lower storeroom 20*b* while installed at the cabinet 10. The storeroom cover 19 may be almost coplanar with the rear wall of the inner case 120 to cover a step formed between the rear wall of the inner case 12 and the duct module 120 and 130 of the cooling module 100. With this structure, the refrigerator 1 may allow the inside of the lower storeroom 20*b* to be neatly designed.

Figure 13:
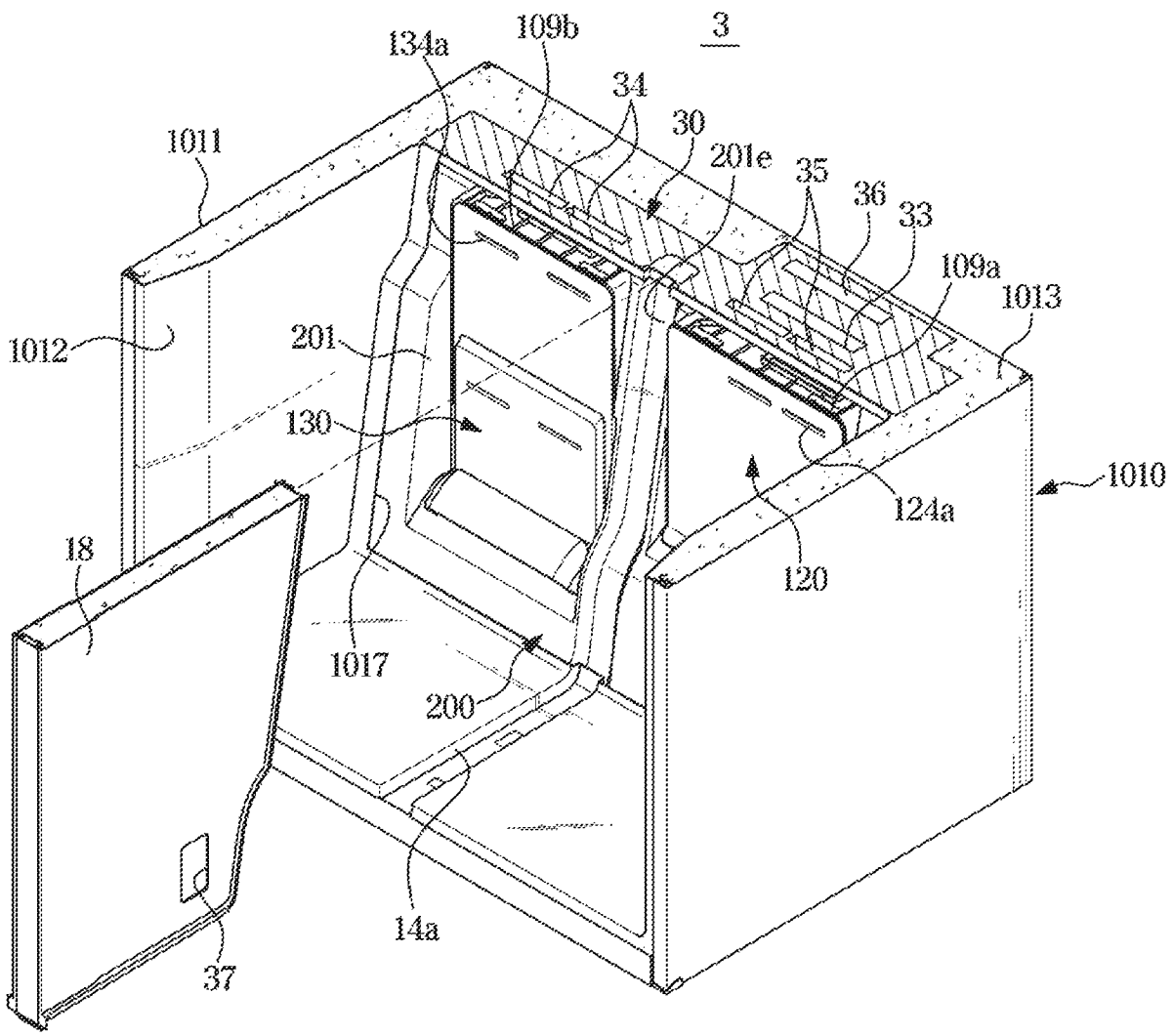
FIG. 13 shows a duct module being separated through a duct opening in a refrigerator, according to another embodiment of the disclosure.

FIG. 13 shows a duct module being separated through a duct opening in a refrigerator, according to another embodiment of the disclosure.

Referring to FIG. 13, a refrigerator 3 according to another embodiment will be described. The same parts as those in FIGS. 1 to 12 will have the same reference numerals, and the detailed description thereof will not be repeated.

Referring to FIG. 13, a cabinet 1010 of the refrigerator 3 may include a single duct opening 1017. A part to support the rear side of the separation plate 18 may be omitted from inner and outer cases 1012 and 1011 of the cabinet 1010. A part to separate the first duct opening 17*a* from the second duct opening 17*b* may be omitted from the cabinet 1010.

The cabinet 1010 may include the separation plate installation part 14 to support the bottom of the separation plate 18. The rear side of the separation plate 18 may be supported by a separation plate installation groove 201*e* formed in the module body 201 of the cooling module 200. In the embodiments described above in connection with FIGS. 1 to 12, the rear side of the separation plate 18 is supported by the cabinet 10, but in the embodiment shown in FIG. 13, the rear side of the separation plate 18 may be supported by the cooling module 200. A sealing member (not shown) may be arranged between the separation plate installation groove 201*e* and the rear side of the separation plate 18.

Figure 14:
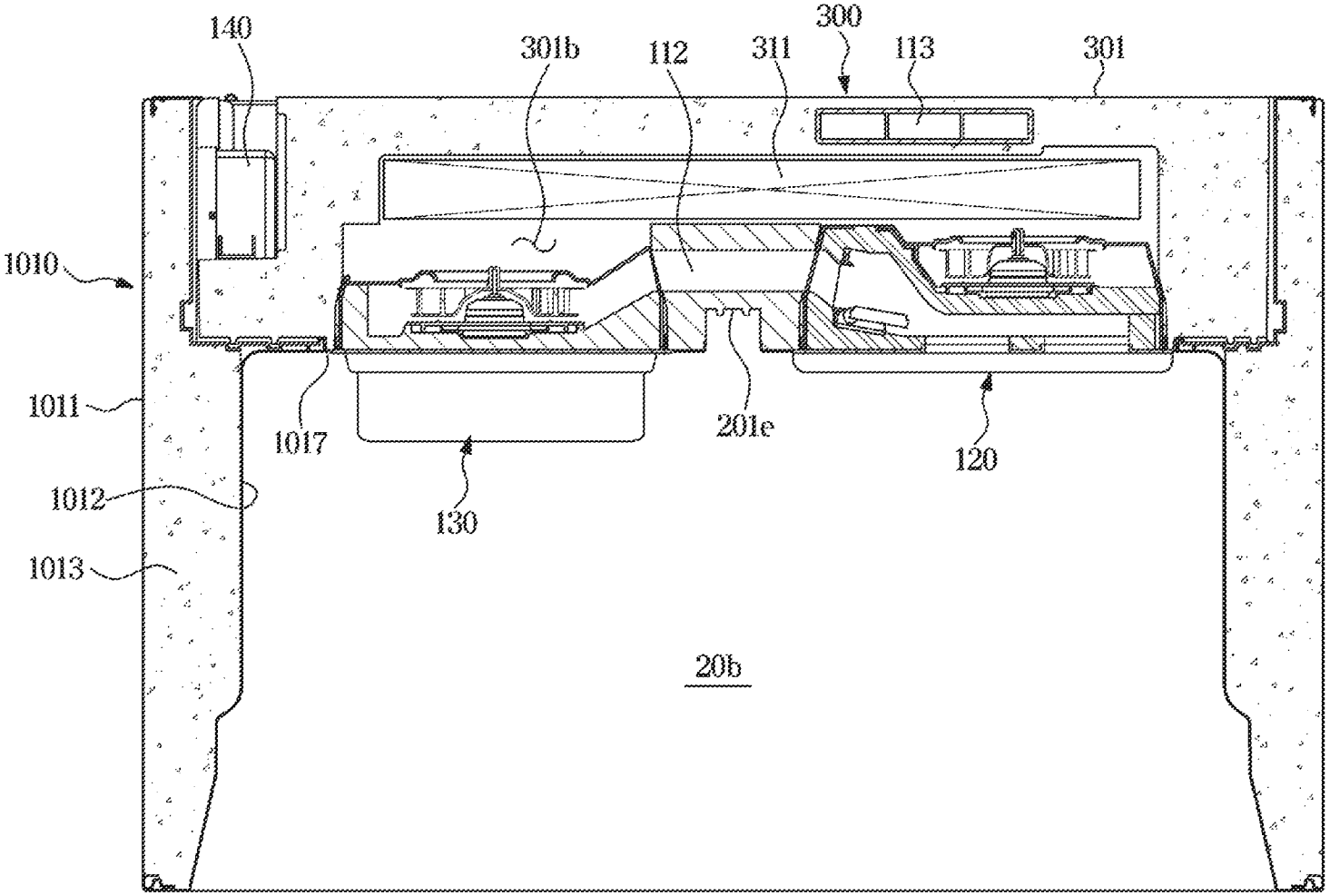
FIG. 14 is a cross-sectional view of a refrigerator, according to another embodiment of the disclosure.

FIG. 14 is a cross-sectional view of a refrigerator, according to another embodiment of the disclosure.

Referring to FIG. 14, a refrigerator 4 according to another embodiment will be described. The same parts as those in FIGS. 1 to 13 will have the same reference numerals, and the detailed description thereof will not be repeated.

Referring to FIG. 14, a cooling module 300 of the refrigerator 4 may include a single evaporator 311. Specifically, a single receiver 301*b* may be arranged in a module body 301 of the cooling module 300, and the evaporator 311 may be arranged in the single receiver 301*b*.

The cabinet 1010 of the refrigerator 4 may include a single duct opening 1017. The cold air discharged from the first and second duct modules 120 and 130 may cool down the single lower storeroom 20*b*.

The refrigerator 4 shown in FIG. 14 is designed to use the lower storeroom 20*b* as a single storeroom without dividing the lower storeroom 30*b*, so the separation plate 18 is not installed. However, like the module body 201 shown in FIG. 13, the module body 301 may include the separation plate installation groove 201*e*. Accordingly, it is possible for the worker to install the separation plate 18 in the cooling module 300 and use it in an occasion when the cooling module 300 shown in FIG. 14 is applied to the cabinet 1010 shown in FIG. 13.

According to embodiments of the disclosure, a refrigerator may allow a cold air supply system to be easily maintained or repaired because an evaporator is installed with a compressor and a condenser in a cooling module that is detachably arranged at a cabinet.

According to embodiments of the disclosure, a refrigerator is provided to have a cooling module containing an evaporator, which may be detachably installed at a cabinet, thereby enhancing a manufacturing process of the refrigerator and increasing the productivity.

According to embodiments of the disclosure, a refrigerator may allow a cold air supply system to be easily maintained or repaired because a duct module may be separated through a storeroom when a cooling module is installed at a cabinet.

Several embodiments have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. A refrigerator comprising:

a cabinet in which a storeroom is formed and including a duct opening;

a cooling module detachably coupled to the cabinet and including an evaporator, a condenser, a compressor, a module body having a space in which the evaporator is accommodated, and a duct module having an opening and being detachably coupled to the module body to guide cold air produced from the evaporator through the opening of the duct module to the storeroom, wherein the duct opening, the duct module and the storeroom are arranged so that, when the duct module is detached from the module body, the duct module is passable through the duct opening to be removed through the storeroom, and the refrigerator further comprises a cover installable so as to cover the duct opening while the duct module is coupled to the module body and to form a portion of a rear wall of the storeroom, and having an opening so that, when the cover is installed, the cold air produced from the evaporator is guided through the opening of the duct module and then through the opening of the cover to the storeroom.

2. The refrigerator of claim 1, wherein, when the duct module is removed, the evaporator is exposed, and thereby accessible, through the storeroom and the duct opening.

3. The refrigerator of claim 1, wherein the cooling module comprises a base plate underneath the module body, and the compressor and the condenser are coupled to the base plate.

4. The refrigerator of claim 1, further comprising:

a sealing member arranged where the cooling module and the cabinet are coupled to each other.

5. The refrigerator of claim 4, wherein the sealing member is arranged along an outer edge of a periphery of the duct opening.

6. The refrigerator of claim 4, wherein the sealing member has a portion extending along a periphery of the space.

7. The refrigerator of claim 1, wherein the duct module comprises:

a fan configured to circulate air in the storeroom, a fan case having a fan inlet formed to guide air that has exchanged heat with the evaporator to the fan, and a fan cover having a cover hole formed to guide air blown by the fan to the storeroom.

8. The refrigerator of claim 7, wherein the fan is fixed to the fan cover, and the fan cover is detachable from the fan case.

9. The refrigerator of claim 1, wherein the duct module comprises a duct inlet formed to guide air in the storeroom to the evaporator.

10. The refrigerator of claim 1, wherein the cabinet comprises a separation plate dividing the storeroom into a first storeroom and a second storeroom, and the duct module comprises a first duct module to discharge cold air into the first storeroom, and a second duct module to discharge cold air into the second storeroom.

11. The refrigerator of claim 10, wherein the separation plate is detachably coupled to the cabinet or the module body.

12. The refrigerator of claim 10, wherein the duct opening comprises a first duct opening through which the first duct module is passable to be removed through the first storeroom, and a second duct opening through which the second duct module is passable to be removed through the second storeroom.

13. The refrigerator of claim 1, wherein the cabinet forms a cooling module receiving space which is opened to outside of the refrigerator when the cooling module is detached from the cabinet, and, when the cooling module is coupled to the cabinet, the cooling module is accommodated in the cooling module receiving space.

14. A refrigerator comprising:

a cabinet in which a storeroom is formed and including a duct opening;

an evaporator;

a module body in which the evaporator is accommodated; and a duct module having an opening and being detachably coupled the module body to guide air from the evaporator through the opening of the duct module to the storeroom, wherein the duct opening, the module body and the storeroom are arranged so that, when the duct module is detached from the module body, the duct module is passable through the duct opening to be removed through the storeroom, and, when the duct module is removed, the evaporator is accessible through the storeroom and the duct opening, and the refrigerator further comprises a cover installable so as to cover the duct opening while the duct module is coupled to the module body and to form a portion of a rear wall of the storeroom, and having an opening so that, when the cover is installed, the air from the evaporator is guided through the opening of the duct module and then through the opening of the cover to the storeroom.

15. The refrigerator of claim 14, further comprising:

a cooling module including the module body and the evaporator, and further including a compressor and a condenser, wherein the cooling module is detachably coupled to the cabinet.

16. The refrigerator of claim 14, wherein the module body is detachably coupled to the cabinet, and the refrigerator further comprising:

a sealing member arranged where the module body and the cabinet are coupled to each other.

17. The refrigerator of claim 14, wherein the duct module comprises:

a fan configured to circulate air in the storeroom;

a fan case having a fan inlet formed to guide air that has exchanged heat with the evaporator to the fan; and a fan cover having a cover hole formed to guide air blown by the fan to the storeroom.

18. The refrigerator of claim 14, further comprising:

a separation plate detachably installed in the cabinet to divide the storeroom, wherein the duct opening comprises a first duct opening arranged on one side of the separation plate and a second duct opening arranged on the other side of the separation plate.

19. The refrigerator of claim 15, wherein the cabinet forms a receiving space which is opened to outside of the refrigerator when the cooling module is detached from the cabinet, and, when the cooling module is coupled to the cabinet, the cooling module is accommodated in the receiving space.

* * * * *